US005220300A

United States Patent [19]

Snyder

[11] Patent Number: 5,220,300

[45] Date of Patent: Jun. 15, 1993

[54] RESONATOR FILTERS WITH WIDE STOPBANDS

[75] Inventor: Richard V. Snyder, Ringwood, N.J.

[73] Assignee: RS Microwave Company, Inc., Butler, N.J.

[21] Appl. No.: 869,467

[22] Filed: Apr. 15, 1992

[51] Int. Cl.[5] ..... H01P 1/208

[52] U.S. Cl. ..... 333/210; 333/212; 333/230

[58] Field of Search ..... 333/202, 208-212, 333/219.1, 227, 230, 228, 251

[56] References Cited

U.S. PATENT DOCUMENTS

| | | | |
|---|---|---|---|
| 3,495,192 | 11/1966 | Gerlack | 333/202 |
| 4,124,830 | 11/1978 | Ren | 333/208 |
| 4,138,652 | 11/1979 | Nishikawa et al. | 333/251 |
| 4,692,723 | 9/1987 | Fiedziuszko et al. | 333/202 |
| 4,752,753 | 6/1988 | Collins et al. | 333/209 |
| 5,051,713 | 9/1991 | Yokota | 333/212 |

OTHER PUBLICATIONS

Snyder, "Broadband Waveguide or Coaxial Filters w/wide Stopbands, Using . . . Approach" Microwave-Journal, Dec. 1983, pp. 83-88.

Snyder "New Application . . . Design", IEEE Transations on Microwave Theory & Techniques, Dec. 1977, pp. 1013-1021.

Craven and Mok, "The Design . . . Characteristic", IEEE Trans. on Micro. Theory & Tech., Mar. 1971, pp. 295-308.

Mok et al., "Susceptance-loaded . . . filters", IEEE Proceedings, Apr. 1972. pp. 416-420.

Chen and Zaki, "A Novel . . . Filters", IEEE Trans. on Microwaves Theory & Tech. Dec. 1990, pp. 1885-1893.

Madrangeas et al., "Analysis . . . Resonator, Microwave Filters", IEEE Trans. on Microwave Theory & Tech., Jun. 1992, pp. 120-127.

Cohn, "Microwave . . . Resonators", Trans. on Micro. Theory & Tech., Apr. 1968, pp. 218-224.

Plouride and Ren, "Dielectric Resonators . . . Components", IEEE Trans. on Microwave Theory & Tech. pp. 755-759 Aug. 1981.

Ng "Tabulation of Methods . . . Problem", IEEE Transactions on Microwave Theory & Tech, Mar. 1974, pp. 322-329.

*Primary Examiner*—Robert J. Pascal
*Assistant Examiner*—Seung Ham
*Attorney, Agent, or Firm*—Ratner & Prestia

[57] ABSTRACT

A system for coupling two resonating cavities, where the coupling system provides a form of bandpass or bandstop filtering about the desired frequency mode and helps suppress undesired modes about the desired frequency mode and higher order modes. The system for coupling the two resonating cavities includes a tuned evanescent iris, where the tunability of the iris is provided by at least one tunable resonating capacitance element embedded in the iris.

16 Claims, 3 Drawing Sheets

RESONATOR FILTERS WITH WIDE STOPBANDS

TECHNICAL FIELD

The invention pertains to the field of filtering electromagnetic energy by the use of a series of coupled resonating cavities.

BACKGROUND OF THE INVENTION

Commonly, resonators are coupled to each other by a variety of means such as irises, screws, windows, polarization and notches for example. When these coupling devices are used in narrow band filters, they act as barriers to a large portion of the resonator field thus allowing only a small portion of the resonator field to be coupled between resonators.

A useful coupling device is a below-cutoff section which does not propagate certain resonator energy due to the intrinsic limitations of the coupling device as disclosed in U.S. Pat. No. 4,692,723. However, these devices permit (pass) undesired modes about the desired frequency mode to be coupled since they are not far below cutoff. Thus, while these coupling devices generally provide adequate cutoff for the desired operating mode, undesired modes about the desired frequency mode and higher order frequency modes are permitted to leak through.

Tuning pins or mode filters may individually suppress modes as disclosed in U.S. Pat. Nos. 4,138,652 and 3,495,192. However, there is no general device which may suppress all the undesired higher order frequency modes and undesired modes about the desired frequency mode.

SUMMARY OF THE INVENTION

This invention provides a device and method for suppressing a wide range of frequency modes by the use of tuned evanescent mode irises as a system which couples resonating cavities. The evanescent mode irises are tuned by use of imbedded capacitor(s) and the iris acts as a bandpass or bandstop filter due to the interactions with the resonating cavities since the iris is located between two resonating cavities and thus acts as a coupling device for the resonating cavities.

By adjusting the capacitors in the irises and accounting for junction susceptance incurred at the boundaries between the iris and the cavities and the shape and length of the iris itself, the iris may be tuned to act a bandpass or bandstop filter. The iris thus may be used to suppress the coupling of a range of frequency modes including the higher order frequency modes that are supported by the resonating cavities along with the undesired frequency modes about the desired frequency mode.

DETAILED DESCRIPTION OF THE INVENTION

Figure 1:
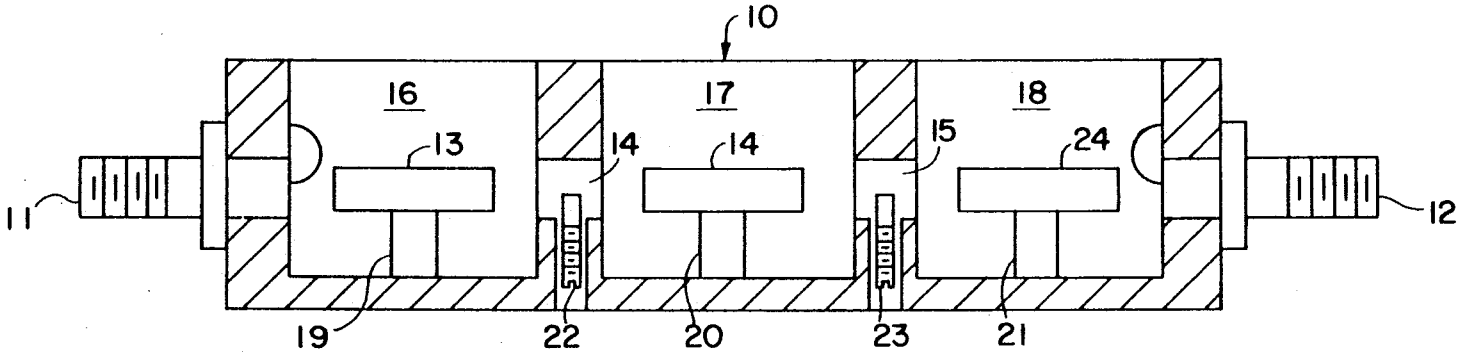
FIG. 1 is cross sectional view of the three pole filtering system 10.

The filtering system 10 shown in FIG. 1 is one embodiment of the current invention. The system 10 receives an input signal through connector 11 and generates a filtered output signal through connector 12. The input signal is coupled from the input connector 11 to a first resonating cavity 16. The signal then is coupled from the first resonating cavity 16 to the second resonating cavity 17 by the first tuned evanescent iris 14. Then the signal is coupled from the second resonating cavity 17 to the third resonating cavity 18 by the second tuned evanescent iris 15. Last, the signal is coupled from the third resonating cavity to the output connector 12.

In detail, a signal is input into the first resonating cavity 16 through a low loss coupling device 11. Resonating cavity 16 resonates only the desired frequency mode along with undesired higher order frequency modes and modes about the desired frequency mode. The frequency modes resonated in resonating cavity 16 are a function of the dimensions of the resonating cavity and the presence of the dielectric resonator 13 located in resonating cavity 16. Resonating cavity 16 contains a high Q dielectric resonator (puck) 13 supported on a low dielectric constant support 19, where Q refers to the quality factor of the resonator and may be calculated as $2\pi$ times the total energy stored divided by the decrease in energy in 1 cycle.

The signal is then coupled from the first resonating cavity 16 to the second resonating cavity 17 by the first tuned evanescent iris 14. The junction between the first resonating cavity 16 and the first tuned evanescent iris 14 is used to achieve a wide range of interstage coupling coefficients at the dielectric resonator's resonant frequency while also achieving a large reduction in the coupling coefficient of frequencies different from the desired frequency.

As the input signal passes from the first resonating cavity 16 into the first tuned evanescent iris 14 a susceptive discontinuity is generated from reflections at the junction. The selection of the first tuned evanescent iris 14 transverse dimension 14*b* and axial or long dimension 14*a* provides cut-off frequencies. In addition a tunable capacitor 22 is embedded in the first tuned evanescent iris 14. More than one tunable capacitor may be embedded in an iris.

The susceptive discontinuity, cut-off frequencies, and the tunable capacitor(s) 22 in the first tuned evanescent iris 14 act in combination to select the desired center frequency while rejecting higher order frequency modes and modes about the desired center frequency and thus acts as a bandpass or bandstop filter.

After being coupled from the first resonating cavity 16 to the second resonating cavity 17, the signal is subject to the resonating effects of the second resonating cavity 17 in a similar manner as in the first resonating cavity 16 due to the physical dimensions of the resonating cavity 17 and the presence of the dielectric resonator 14 which is supported by a low dielectric material 20.

Likewise, as the signal is coupled from the second resonating cavity 17 to the third resonating cavity 18 by the second tuned evanescent iris 15, the signal is subject to similar filter processing that occurred in the coupling from the first to the second resonating cavities. However, the filter processing in the second coupling, i.e., from the second resonating cavity 17 to the third resonating cavity 18, is additive to the effects of the first coupling. That is, the second coupling by the second evanescent iris 15 serves to further reduce the amplitude of higher order frequency modes and undesired frequency modes about the desired frequency mode that are in the stopband or outside the passband of the filter generated by the combination of the junction susceptance, the second tuned evanescent iris's 15 cutoff frequency, due to its physical dimensions (shape and length) and the capacitor(s) 23 imbedded in the tuned evanescent iris 15.

Finally, after being coupled from the second resonating cavity 17 to the third resonating cavity 18, the signal is subject to the resonating effects of the third resonating cavity 18 in a similar manner as in the first resonating cavity 16 and second resonating cavity 17 due to the physical dimensions of the resonating cavity 18 and the presence of the dielectric resonator 24 which is supported by a low dielectric material 21. The signal is then coupled to the output connector 12.

Figure 2:
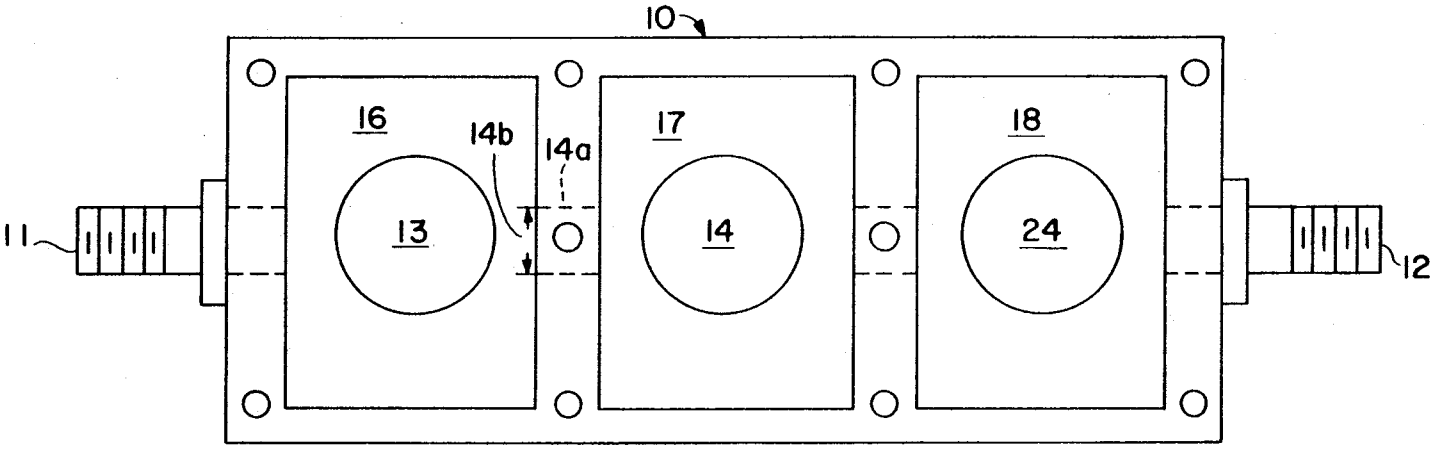
FIG. 2 is an exposed view perspective from above the three pole filter system 10.

FIG. 2 shows an exposed view of the filtering system 10 from above the system. As illustrated in FIG. 2, the dielectric resonators 13, 14, and 15 are located in the center of their respective resonating cavities 16, 17, and 18. The physical relationships of the resonating cavities, dielectric resonators, and tuned evanescent irises will be explained in greater detail through the aid of FIGS. 3 and 4.

Figure 3:
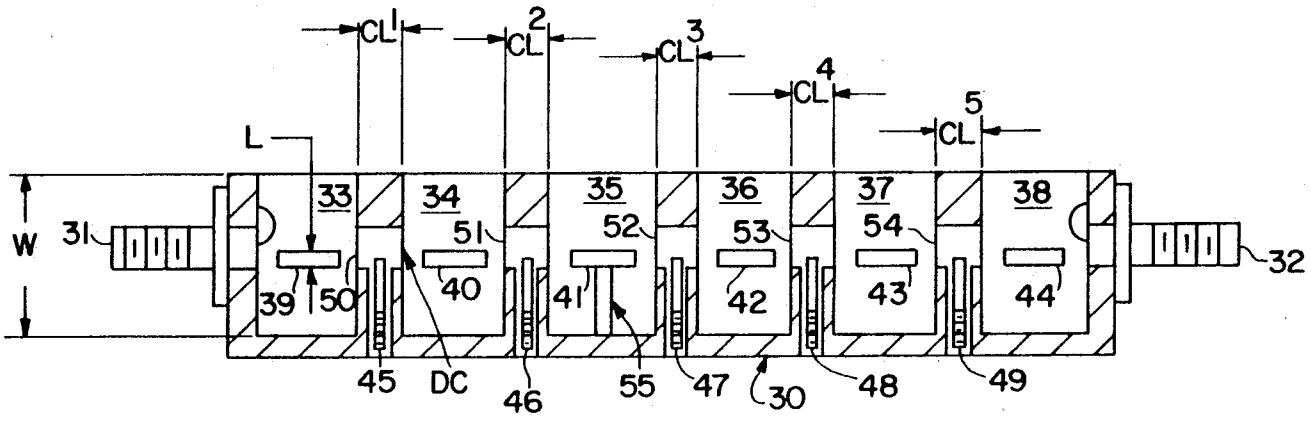
FIG. 3 is cross sectional view of the six pole filtering system 30.
Figure 4:
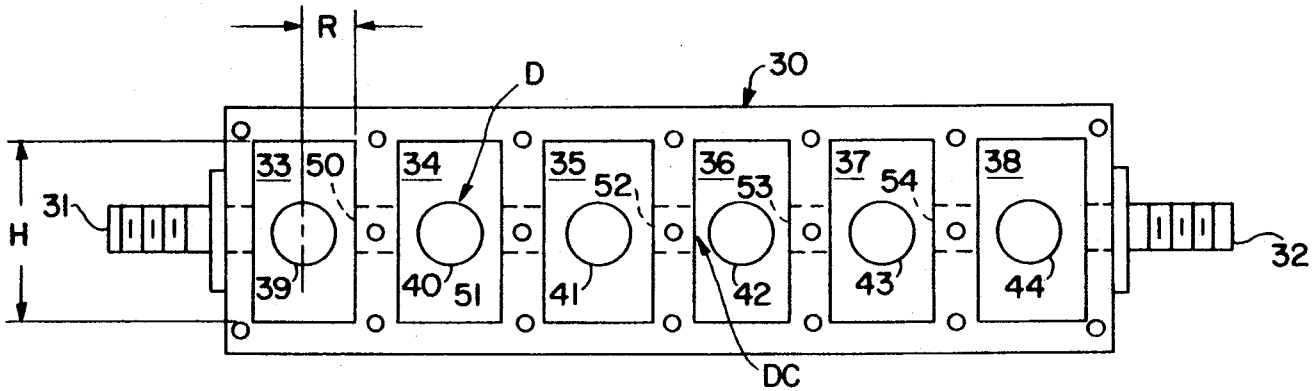
FIG. 4 is an exposed view perspective from above the six pole filter system 30.

Another exemplary embodiment of the current invention is shown in FIGS. 3 and 4. FIGS. 3 and 4 illustrate a filtering system 30 which has six resonating cavities and thus is a six pole filter. Each of the six cavities are coupled together by tuned evanescent irises similar to those irises described in FIG. 1. FIG. 3 is cross sectional view of the six pole filtering system 30 and FIG. 4 is an exposed view perspective from above of the six pole filter system 30.

A signal enters the six pole filtering system 30 through the input coupling device 31. The input coupling device 31 couples the signal into the first resonating cavity 33 ( or pole) of the six pole filtering system 30.

Due to the physical dimensions and presence of a high Q dielectric resonator 33, the signal propagates in the $TE_{01\delta}$ mode about a frequency $f_r$ along with higher order modes and undesired modes about $f_r$.

The dielectric resonator 33 free space resonates in the dominant $TE_{01\delta}$ mode. The resonator is selected to resonate at a frequency below the desired ultimate operating center frequency to adjust for the effects of frequency pushing generated by the present of metal walls in which the dielectric resonator is enclosed. The closer the walls of the enclosed area are to the dielectric resonator, the greater the adjustment to account for frequency pushing.

In addition, the dimensions of the cavity must be below cutoff relative to the operating mode of the resonating dielectric 39. Thus, W, H, and R must be selected so that all dimensions are below dominant mode cutoff, i.e., are too small for energy to propagate except as resonated by the dielectric resonator 39 for the dielectric resonator 39 to operate effectively within the first resonating cavity 33.

The resonating frequency, $f_r$, that will be supported in the first resonating cavity and similarly for the other cavities may be determined by modifying the equations given in an article by S. B. Cohn, entitled Microwave Bandpass Filters Containing High-Q Dielectric Resonators from the IEEE Trans. MTT, April 1968 which is incorporated by reference for its teachings on calculation of the dielectric resonant frequency, to account for the frequency pushing effect caused by the metal walls of the first resonating cavity. It may be shown that:

$$\beta tan(\beta L/2)=\alpha$$

$$\beta=2\pi((\epsilon_r/\tau_{02})-(0.68/D^2))^{\frac{1}{2}}$$

$$\alpha=2\pi((0.68/D^2)-(1.0/\tau_{02}))^{178}$$

$$f_r=11.803/\tau_0\ (\text{GHz})$$

where: $\tau_0$=free space wavelength,

D=dielectric resonator diameter as shown in FIG. 4,

L=the dielectric resonator length as shown in FIG. 3, and $\epsilon_r$=permittivity of the dielectric resonator relative to $\epsilon_0$.

These equations may be solved to determine $f_r$ in the $TE_{01\delta}$ mode using iterative methods.

The dielectric resonator support 55 which is used in each cavity is a low dielectric constant support made of various materials depending on whether the application is for a low power application or a high power application. For a low power application, the support 55 may be made of Rexolite, a low dielectric constant form, or any material with similar properties. For a high power application, the support 55 may be made of a thermally conductive low dielectric constant ceramic or any material with similar properties.

Thus, cavity 33 will tend to resonate frequencies about $f_r$ along with other higher order frequency modes. However, as the signal is coupled from the first resonating cavity 33 to the second resonating cavity 34 through the first tuned evanescent iris 50 a number of interactions effect the signal.

The interactions generated by the coupling of the first resonating cavity 33 to the second resonating cavity 34 through the first tuned evanescent iris 50 include the susceptive discontinuity generated due to the reflections at the interface between the first resonating cavity 33 and the first tuned evanescent iris 50, the cutoff frequency of the iris due to its transverse dimension DC (shape), the attenuation of the cutoff due to the axial or long length dimension $CL^1$ (length) of the iris, and the effect of the resonating capacitor(s) 45 imbedded in the iris.

The interactions caused by coupling described above may be used to generate a wide range of interstage coupling coefficients at the dielectric resonator's resonant frequency, $f_r$, with a large reduction in the coupling coefficients occurring at frequencies away from the desired one, $f_r$.

Figure 5B:
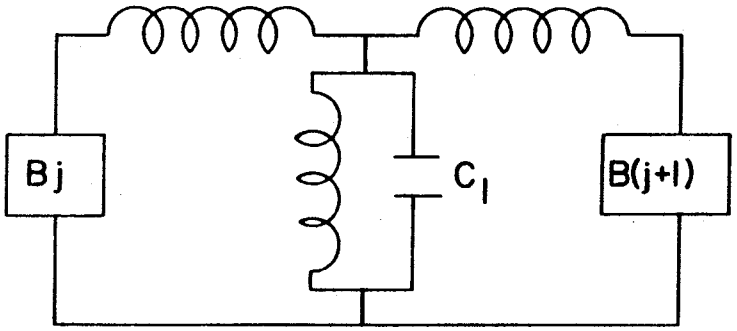
FIG. 5*b* is an equivalent circuit of a resonated evanescent iris which does account for the interactive effects generated by the susceptive discontinuity and the single resonating capacitor embedded in the iris.
Figure 5A:
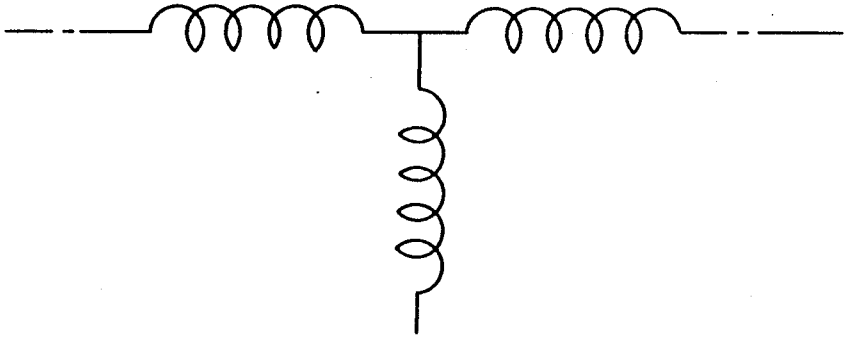
FIG. 5a PRIOR ART
FIG. 5*a* is an equivalent circuit of evanescent iris.
Figure 5C:
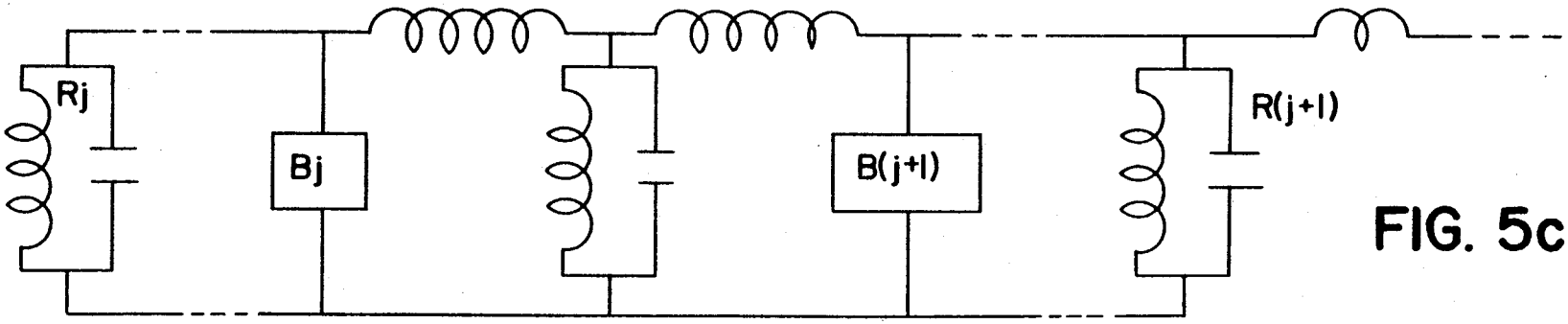
FIG. 5*c* is a composite circuit of the coupling of two resonating cavities coupled by a resonated (tuned) evanescent iris.

FIGS. 5*a* to 5*c* show equivalent circuits that may be used for analysis of the coupling coefficients generated due to the interactions. FIG. 5*a* shows an equivalent circuit of evanescent iris which does not account for the interactive effects due to the susceptive discontinuity or the resonating capacitor(s) embedded in the iris.

FIG. 5*b* is an equivalent circuit of a resonated evanescent iris which does account for the interactive effects generated by the susceptive discontinuity and the single resonating capacitor embedded in the iris. In FIG. 5*b*, the elements Bj and B(j+1) model the interactions effects of the susceptive discontinuity and the capacitor $C_1$ models the interaction effects of the a single capacitor embedded in the iris.

FIG. 5*c* is a composite circuit of the coupling of two resonating cavities coupled by a resonated (tuned) evanescent iris. As for the circuit shown in FIG. 5*b*, the circuit in FIG. 5*c* accounts for the interaction effects due to the susceptive discontinuity and a resonating capacitor embedded in the iris. In addition, the elements Rj and R(j+1) model the interaction effects of the resonating cavities themselves, for example, resonating cavities 33 and 34. FIG. 5*c* illustrates that all the interactions due to the coupling between the two resonating cavities and the tuned evanescent iris combine to create a bandstop or bandpass filter.

In fact, the combination does such a good job at providing a bandstop or bandpass filter that there is no significant difference between the solution of the coupling coefficient as a mode-matched solution at the iris junction or the assumption of a single mode dielectric resonator coupling. Thus the single mode assumption is sufficient and its formulation is described below.

The single mode coupling coefficient may be determined by evaluating equations which are well known to those who are skilled in the art. In may be shown that:

$$F=0.927D^4L\epsilon_r/\tau_{02}$$

$$k=Fae^{-\alpha 10 s/ab} \quad (1)$$

where: F=coupling factor, a=enclosure width of the iris, b=enclosure height of the iris, k=coupling of dielectric resonator to dielectric resonator with an iris having a rectangular shape, $\alpha^{10}$=attenuation in enclosure (iris), and s=dielectric resonator to dielectric resonator spacing for desired coupling coefficient where it is effective to use s/2 as spacing of the dielectric resonator center to the junction with the tuned evanescent iris, for example R in FIG. 4.

Iris 14 may have any geometric shape. The definable modal cutoff number used in equation (1) may be determined for any geometrically shaped iris by one skilled in the art as described in an article by Fook Loy Ng, entitled Tabulation of Methods for the Numerical Solution of the Hollow Waveguide Problem from the IEEE Transactions on Microwave Theory and Techniques, March 1974 which is incorporated by reference. For example, iris 14 may have a circular shape and then ab, the definable modal cutoff number, would be replaced in equation (1) by 1.707 times the diameter of the iris.

Iris 14 may be a composite of cross sectional shapes. For example iris 14 may start with a certain size rectangular cross sectional shape and change to a certain size circular cross sectional shape and then change to a different size rectangular cross sectional shape. The article by R. Snyder, entitled Broadband Waveguide or Coaxial Filters with Wide stopbands, Using a Stepped-Wall Evanescent Mode Approach from the Microwave Journal, December 1983 which is incorporated by reference teaches irises that have a composite of cross sectional shapes.

The above equations show that the coupling by the tuned evanescent iris is a transformation of the magnetic dipole moment from one resonating cavity to the next resonating cavity.

The equations for junction susceptance between a resonating cavity and evanescent iris are given by equations (7) and (8) in the above referenced article by R. Snyder, entitled Broadband Waveguide or Coaxial Filters with Wide stopbands, Using a Stepped-Wall Evanescent Mode Approach.

Thus to design the tuned evanescent iris, the coupling coefficient would be solved for by use of equations (1) and (7) and (8) as referenced earlier. However, the assumption of a single mode is only correct if the iris is configured to select the dominant mode frequency in the resonating cavity, i.e, $f_r$. If this assumption is met, then the coupling coefficient would be selected from the ladder cascade show in an article by R. Snyder. entitled New Application of Evanescent Mode Waveguide to Filter Design from the IEEE Trans. MTT, December 1977 which is incorporated by reference for its teachings on ladder cascades, and set equal to the coupling coefficient, k, determined by equation (1). Given the coupling coefficient, either the iris length or iris diameter (if a circular iris) may be solved for given one of the two using standard iterative techniques.

It is also possible to make higher order filters by using the spacing shown in the two above referenced articles.

While the invention has been described in terms of an exemplary embodiment, it is contemplated that it may be practiced with modifications within the spirit and scope of the appended claims.

What is claimed:

1. A system for coupling two resonating cavities comprising:

iris means coupled between the two resonating cavities;

said iris means including at least one tunable resonating capacitance element; and said iris means defining an opening having a shape and length between the two cavities where the shape and length of said iris means and said resonating capacitance element function as a bandpass filter about the desired frequency mode supported by the resonating cavities for suppressing undesired modes.

2. A system for coupling two resonating cavities for suppressing undesired modes about a desired frequency mode comprising:

iris means coupled between the two resonating cavities;

said iris means including at least one tunable resonating capacitance element;

said iris means and at least one of the said resonating cavities having junction susceptance therebetween; and said iris means defining an opening having a shape and length between the two cavities where the shape and length of said iris means, said junction susceptance, and said resonating capacitance elements function as a bandpass filter about the desired frequency mode supported by the resonating cavities for suppressing the undesired modes.

3. The system of claim 1 in which each resonating cavity includes a high Q dielectric resonator.

4. The system of claim 2 in which each resonating cavity includes a high Q dielectric resonator.

5. The system of claim 1 in which each resonating cavity includes a high Q multi mode resonator.

6. The system of claim 2 in which each resonating cavity includes a high Q multi mode resonator.

7. The system of claim 1 in which each resonating cavity includes a high Q multi mode dielectric resonator.

8. The system of claim 2 in which each resonating cavity includes a high Q multi mode dielectric resonator.

9. The system of claim 1 in which a cross-sectional shape of said opening has a definable modal cutoff number.

10. The system of claim 2 in which a cross-sectional shape of said opening has a definable modal cutoff number.

11. The system of claim 1 in which the shape of said opening is one of rectangular and circular.

12. The system of claim 2 in which the shape of said opening is one of rectangular and circular.

13. The system of claim 1 in which said opening is a composite of cross sectional shapes with definable modal cutoff numbers.

14. The system of claim 2 in which said opening is a composite of cross sectional shapes with definable modal cutoff numbers.

15. The system of claim 1 in which said opening is a composite of cross sectional shapes with definable modal cutoff numbers and a plurality of resonating capacitance elements.

16. The system of claim 2 in which said opening is a composite of cross sectional shapes with definable modal cutoff numbers and a plurality of resonating capacitance elements.

* * * * *